US009440770B2

(12) United States Patent
Mueller

(10) Patent No.: US 9,440,770 B2
(45) Date of Patent: Sep. 13, 2016

(54) PLASTIC PALLET FOR FLEXIBLE BULK CONTAINERS

(71) Applicant: Cabka GmbH & Co. KG, Weira (DE)

(72) Inventor: Stefan Mueller, Gera (DE)

(73) Assignee: CABKA GMBH & CO. KG, Weira (DE)

( * ) Notice: Subject to any disclaimer, the term of this patent is extended or adjusted under 35 U.S.C. 154(b) by 0 days.

(21) Appl. No.: 14/682,203

(22) Filed: Apr. 9, 2015

(65) Prior Publication Data

US 2015/0291305 A1 Oct. 15, 2015

(30) Foreign Application Priority Data

Apr. 11, 2014 (EP) ..... 14164381

(51) Int. Cl.
*B65D 19/38* (2006.01)
*B65D 19/00* (2006.01)

(52) U.S. Cl.
CPC ..... *B65D 19/0036* (2013.01); *B65D 19/0034* (2013.01); *B65D 19/385* (2013.01); *B65D 2519/00034* (2013.01); *B65D 2519/00069* (2013.01); *B65D 2519/0094* (2013.01); *B65D 2519/00268* (2013.01); *B65D 2519/00288* (2013.01); *B65D 2519/00318* (2013.01); *B65D 2519/00343* (2013.01); *B65D 2519/00348* (2013.01); *B65D 2519/00407* (2013.01); *B65D 2519/00412* (2013.01); *B65D 2519/00796* (2013.01); *B65D 2519/00805* (2013.01); *B65D 2519/00815* (2013.01)

(58) Field of Classification Search
CPC ..... B65D 19/0036; B65D 19/385; B65D 2519/00268; B65D 2519/00034; B65D 2519/00069; B65D 2519/00348; B65D 2519/00412; B65D 2519/00796; B65D 2519/00805
USPC ..... 108/57.25, 57.28, 57.31, 57.12, 57.22, 108/57.14, 57.15, 57.13, 53.3, 55.3, 57.23
See application file for complete search history.

(56) References Cited

U.S. PATENT DOCUMENTS 2,461,887 A * 2/1949 Fletcher ..... B65D 19/0095 108/57.14
2,487,687 A * 11/1949 Arthur ..... B65D 19/0026 108/57.14
2,930,481 A * 3/1960 Bebie ..... B65D 19/0026 108/56.3
3,112,715 A * 12/1963 Callahan ..... B65D 19/0048 108/51.3
3,120,825 A * 2/1964 Johnson ..... B65D 19/004 108/53.3
3,167,341 A * 1/1965 Higgins ..... B65D 19/0048 108/53.3

(Continued)

FOREIGN PATENT DOCUMENTS

EP 0 521 478 A1 1/1993
FR 1 603 898 A 6/1971

(Continued)

*Primary Examiner* — Jose V Chen
(74) *Attorney, Agent, or Firm* — Christensen Fonder P.A.

(57) ABSTRACT

A plastic pallet for receiving flexible bulk containers comprises at least one pair of tunnel-shaped receptacles for the fork tines of a forklift, with the tunnel-shaped receptacles connecting two opposite sides of the plastic pallet. Each tunnel-shaped receptacle has a tunnel bottom that is formed by bottom ribs spaced by bottom air gaps. Each tunnel-shaped receptacle also has a tunnel vault that is formed by vault ribs spaced by vault air gaps. In each of the tunnel-shaped receptacles, the bottom ribs and vault ribs are staggered and dimensioned in such a way that a bottom rib is arranged below a vault air gap and a vault rib is arranged above a bottom air gap.

20 Claims, 5 Drawing Sheets

(56) References Cited

U.S. PATENT DOCUMENTS

| | | | | |
|---|---|---|---|---|
| 3,227,108 | A * | 1/1966 | Greaves | B65D 19/0095 108/53.3 |
| 3,587,481 | A | 6/1971 | Kincade | |
| 3,756,167 | A * | 9/1973 | Wilson | B65D 19/0026 108/53.1 |
| 4,145,974 | A | 3/1979 | Fleming et al. | |
| 6,012,399 | A * | 1/2000 | Carter | B65D 19/0097 108/51.3 |
| 7,516,706 | B2 * | 4/2009 | Creighton | B65D 19/0026 108/56.3 |
| 8,336,465 | B2 * | 12/2012 | Poulsen | B65D 19/0095 108/55.1 |
| 2004/0118725 | A1 * | 6/2004 | Shuert | B65D 19/0028 206/386 |
| 2010/0050910 | A1 * | 3/2010 | Durco | B65D 19/0012 108/57.31 |
| 2010/0101460 | A1 * | 4/2010 | Kelly | F16N 31/006 108/55.3 |
| 2010/0199889 | A1 * | 8/2010 | Cramer | B65D 19/0026 108/53.5 |
| 2010/0322538 | A1 | 12/2010 | Powell et al. | |
| 2011/0239910 | A1 * | 10/2011 | Chambless | B32B 38/0004 108/57.16 |
| 2011/0265695 | A1 * | 11/2011 | Moore | B21F 27/12 108/53.3 |
| 2013/0136573 | A1 | 5/2013 | Berry et al. | |
| 2014/0190372 | A1 * | 7/2014 | Smolenaers | B65D 19/0016 108/50.11 |

FOREIGN PATENT DOCUMENTS

| | | | |
|---|---|---|---|
| GB | 2 103 573 | A | 2/1983 |
| WO | WO 2010/151367 | A1 | 12/2010 |
| WO | WO 2013/013705 | A1 | 1/2013 |

* cited by examiner

PLASTIC PALLET FOR FLEXIBLE BULK CONTAINERS

PRIORITY CLAIM

The present application claims priority to European Patent Application No. 14 164 381.7, filed on Apr. 11, 2014, which said application is incorporated by reference in its entirety herein.

FIELD OF THE INVENTION

The invention relates to a plastic pallet for supporting flexible bulk containers.

BACKGROUND OF THE INVENTION

Flexible bulk containers—also known as flexible intermediate bulk containers (FIBC)—are used for transporting and storing bulk dry goods. Such bulk goods occur in many fields, such as, for example, sand, cement or soil in the field of building materials; flour, cereal grains etc. in the food field; and, e.g., plastic pellets in the manufacturing industry. The flexible bulk containers may be made of various materials and are characterized in that they are flexible, i.e., that rather than having a rigid form such as cases or cardboard boxes, these containers have bordering faces or walls that give. The containers are more or less sack-like, of various shapes, with or without openings for emptying or filling. The size of the containers and the material they are made from are chosen to suit the cargo with which they are to be filled. For cement having a high specific weight, e.g., smaller sacks are used that often consist of several walls of strong paper. For the transportation of foods, one must see to it that the inside wall of the container is food-compatible, i.e., that no chemical reactions will occur between the food to be transported and the inner wall of the container. For transporting light goods of low specific weight, which allows the use of larger bulk containers, so-called bulk bags, also known as big bags, have become established in prior art.

For transporting such flexible bulk containers, the widely used wooden pallets, including those knows as EUR-pallets, are fit for limited service only. On the one hand, the flexible bulk containers can be damaged by the rough wooden surface, wood splinters sticking out etc. On the other hand, bulk containers having highly flexible side walls will, in the filled state, adapt to the form of the pallet, i.e., due to its weight, the filled bulk container will bulge downward or sag between the deckboards of the wooden pallet, which can, in the worst case, cause the bulk container to be damaged and torn open by the entering tines of the forklift.

Therefore, efforts are being made to find other solutions for the transportation and storage of such flexible bulk containers.

A pallet suitable for the transportation of flexible bulk containers is disclosed, e.g., in US 2013/0136573 A1 and offered by BHA—Bulk Handling Australia. The pallet described in US 2013/0136573 A1 is made of plastic by injection molding. Compared to wood, plastic has the advantage that it can be cast or injected into molds of almost any form; in addition, the surfaces are smoother, which is of advantage for the carriage of flexible bulk containers. On its bottom side, the pallet is provided with tunnel-shaped receptacles, which connect the two opposite sides of the plastic pallet. Plastic pallets for flexible bulk containers generally have a square shape which defines the bearing surface, so that the tunnel-shaped receptacles connect two parallel, opposite sides of such a square. In another embodiment, the pallet exhibits four tunnel-shaped receptacles, which are arranged in pairs crossing each other. Thus, each side of the square pallet is connected with the respective opposite side by tunnel-shaped receptacles. These tunnel-shaped apertures are adapted to permit the tines of a forklift to enter these apertures and pick up the pallet. Between the tunnel-shaped receptacles, which are open at the bottom, there is a central, closed area. On top of the tunnel-shaped configurations there are raised elements A, which stiffen the structure of the pallet. If only one pair of tunnels is used, the raised elements run across the tunnel direction from one side of the pallet to the other side. In case of the pallet having two pairs of tunnel-shaped receptacles, i.e. altogether four tunnel-shaped receptacles, the raised elements connect two adjoining tunnel-shaped receptacles each; in this case, they include a right angle in the central area. As the tunnel-shaped receptacles are open at the bottom, the plastic pallet described in US 2013/0136573 A1 is nestable, i.e. if several pallets of the same design are stacked, they can be nested so that the total height of a stack of n pallets is substantially smaller than the n-fold of the height of a single pallet.

This nestability, though, is a disadvantage if several of these palettes loaded with filled bulk containers are to be stacked: In the same way as described above for wooden pallets, the plastic pallets weigh down on the flexible bulk containers below, which can thus bulge or expand into the open bottoms of the receptacles, because they can, to a certain extent, flexibly respond to a pressure load. As a consequence, the tines of a forklift entering the tunnel-shaped receptacles, which are open at the bottom, can damage the bulk container below the respective pallet. In addition, the nesting will impair the stability of a stack of several loaded pallets.

This is avoided in the system disclosed in WO 2010/151367 A1 and marketed by Sonoco under the trademark FirmaLoad™ WO 2010/151367 A1 describes various embodiments of a bulk container and a support system for bulk containers, with the support system being securable to the bulk container in various ways; also described is an embodiment in which bulk container and support system are inseparable. The support system consists of a plate-shaped bottom with a square base on which the container is, or can be, arranged. Arranged below the plate-shaped bottom are semitubular members receiving the tines of a forklift. These receptacles are preferably made of paperboard, but may also consist of some plastic. The semitubular receptacles are completely closed at the bottom, so that these pallets are not nestable, so that a stack of empty pallets will occupy much more space than nestable pallets would. Due to the concept, only two receptacles can be fastened to the bottom side or top side of the base, so that the pallet cannot be picked up by a forklift from each side. For emptying the bulk container, the base can be provided with a closable flap.

SUMMARY OF THE INVENTION

In embodiments of the invention, a plastic pallet is both nestable and, in the loaded state, stackable, with a bulk container below a plastic pallet in a stack and being protected against damage caused by a forklift.

In embodiments of the invention, a plastic pallet provides tunnel-shaped receptacles each with a tunnel bottom formed by bottom ribs spaced from each other by bottom air gaps. In addition, each tunnel-shaped receptacle features a tunnel vault, which is formed by vault ribs spaced from each other by vault air gaps. In each tunnel-shaped receptacle, bottom ribs and vault ribs are staggered and dimensioned in such a way that a bottom rib is arranged below a vault air gap, and a vault rib is arranged above a bottom gap. Consequently, in the area in which a bottom rib is arranged, there is no vault rib, and in the area covered by a vault rib there is no bottom rib, if the normal of a base plate corresponding to the bearing surface for the bulk containers is used as the reference direction.

In embodiments of the invention, vault ribs and bottom ribs can be configured to cover the air gaps opposite to them with almost precise fit or a slightly loose fit, so that maximum stability is ensured. To improve stackability somewhat and to reduce material consumption, it is also possible, though, to make the vault ribs narrower than the bottom air gap and the bottom ribs narrower than the vault air gaps. Along the longitudinal axis of a tunnel, then, the width of the bottom ribs is in no case greater than the width of a vault air gap arranged above it, and the width of a vault rib is in no case greater than the width of a bottom air gap arranged below it, since otherwise several plastic pallets of the same type would not be nestable.

In embodiments of the invention, the vault ribs may be arch-shaped, because the lack of edges will reduce the risk of damaging the flexible bulk container to be transported.

Bottom ribs and vault ribs each have two ends which may be connected with tunnel sidewalls; i.e. either end is connected with a tunnel sidewall, with the tunnel sidewalls in the tunnel-shaped receptacle lying opposite to each other and across the longitudinal direction of the tunnel. The tunnel sidewalls—preferably located vertically to the base plate or the bearing surface—for one thing increase the stability of the pallet structure; for another, they serve as guideways for the forklift tines, preventing the tines getting caught in the air gaps if they enter the tunnel-shaped receptacles in a direction other than exactly straight. Generally, though, it is also possible to connect the ends of the vault ribs and bottom ribs, rather than with a tunnel sidewall, via a narrow web only, i.e. with the least possible amount of material.

In embodiments of the invention, each plastic pallet comprises four tunnel-shaped receptacles arranged in pairs crossing each other. This increases the flexibility of operation, since the plastic pellet—as a rule provided with a square base plate—can be picked up by a forklift from all four sides. Here, the tunnel-shaped receptacles are arranged in pairs crossing each other, i.e., a first pair of tunnel-shaped receptacles is aligned in parallel to each other and connects two parallel sides of the plastic pallet; the second pair is arranged at right angles with the first pair and connects the other two parallel sides of the plastic pallet. Each tunnel-shaped receptacle of the one pair includes a right angle with two tunnel-shaped receptacles of the other pair, so that there are altogether four crossings for every two tunnel-shaped receptacles. There are various possibilities to configure such a crossing area between every two tunnel-shaped receptacles with the aim of ensuring nestability of the plastic pallet.

As a first possibility, each crossing area of two tunnel-shaped receptacles can be made up by a bottom plate that covers the crossing area and above which no vault ribs are arranged. As another possibility, the crossing area can be made up by a vault that covers the crossing area and under which no bottom plate is arranged.

In order to increase the stability of the pallet and to improve the protection of flexible bulk containers supported by pallet, though, it is of advantage if each crossing area of two tunnel-shaped receptacles comprises a bottom plate that covers the crossing area and is provided with at least one crossing air gap, and if a crossing vault rib is arranged above the at least one crossing air gap, with the crossing air gap including an identical angle, i.e. 45°, with the longitudinal axes of each of the tunnel vaults crossing there. This will substantially increase the stability of support, since the bulk containers can no longer move aside in the corner areas. Further, the tunnel sidewalls can extend into the crossing area so as to strengthen the structure and especially the crossing vault ribs there, where no forklift tines enter.

Both the vault ribs and the crossing vault ribs can be provided with thickenings in the area below the tunnel sidewalls, which further increases the stability of the structure.

Moreover, the obliquely arranged crossing vault ribs prevent the flexible bulk container from expanding into the channel, i.e. into the tunnel area that serves as a guideway for forklift tines, and possibly being damaged by the tines.

The area between den tunnel-shaped receptacles may be permanently closed, e.g., by a grid-like structure, so that the pallet can be made as a single part. Such an embodiment is advantageous, e.g., if the pallet is intended to lift bulk containers of modest size such as cement sacks, e.g. For large bulk containers, especially big bags, however, it is advantageous to provide a hole for discharging the flexible bulk container in the area between the at least two tunnel-shaped receptacles. Such big bags may feature, e.g., closable openings and will be placed on the pallet with the opening facing down. The lid of a big bag can then be opened through the hole, so that the bulk container can be emptied while resting on the pallet.

In an embodiment, the hole is closed with a reversibly removable cover, i.e. made of two parts. In this way it is possible to for the pallet to support bulk containers such as big bags with openings facing down as well as smaller bulk containers or big bags without openings facing down, because the cover prevents the flexible bulk containers from dragging on the ground and getting damaged.

There are several possibilities to attach the cover to the plastic pallet. For example, the cover can be attached to the rims of the hole via a clip fastener, with the hole having any shape, as far as it is limited to the area of the at least two tunnel-shaped receptacles. The cover may just as well be a hinged lid attached to the plastic pallet by means of a hinge provided at the rim of the hole; also, the hinge may be conceived to permit the lid to be completely removed from the plastic pallet. The last-mentioned version can be combined with a clip fastener on the hole side opposite the hinge, other feasible versions being magnetic locks, hook-and-eye fasteners or the like, which, however, requires extra materials to be employed, whereas a mere clip fastener can be integrated into the molds for the pallet and the cover. In the simplest case, with the pallet intended to transport bulk containers without openings, the cover may just be placed loosely on the hole from above.

In another embodiment, the vault ribs are provided with supports for the tines of a forklift, the said supports facing the inside of the tunnels and being preferably of a flat shape running horizontally, i.e. parallel to the base plate. The supports are adapted to come to lie flatly on the likewise flat upper sides of the forklift tines as the tines enter the tunnel-shaped receptacles and the forklift subsequently lifts the pallet; this avoids point loads on the vault ribs and ensures the best possible distribution of the forces exerted by the pressure of the loaded pallet onto the vault ribs or supports, respectively, and by the back-pressure of the tines in this area.

This increases the stability in lifting and transporting a loaded pallet. The vault ribs can be designed as hollow ribs open towards the inside of the tunnel, with stiffening elements being provided in the hollow ribs, and with at least one portion of the stiffening elements having a flat, i.e. horizontal bottom side—which may be, e.g., an edge of a stiffening element—as a support for the forklift tine. However, the vault ribs may also be designed in a closed form with flat supports.

Finally, in another embodiment, the outer sides of such vault ribs, which form a mouth, or entry gateway of a tunnel-shaped receptacle, are adapted to form a flared rim serving as an entry aid for the forklift tine; i.e. the tunnel mouth broadens towards the outside and tapers toward the inside. This is a precaution against damage caused to the plastic pallet if it is picked up by the forklift inattentively.

It is understood that the features mentioned before and those to be explained below are applicable not only in the combinations stated but also in other combinations or as stand-alone features without leaving the scope of the present invention.

Below, the invention will be explained in more detail by examples with reference to the accompanying drawings, which also show features essential to the invention.

DETAILED DESCRIPTION

Figure 1A:
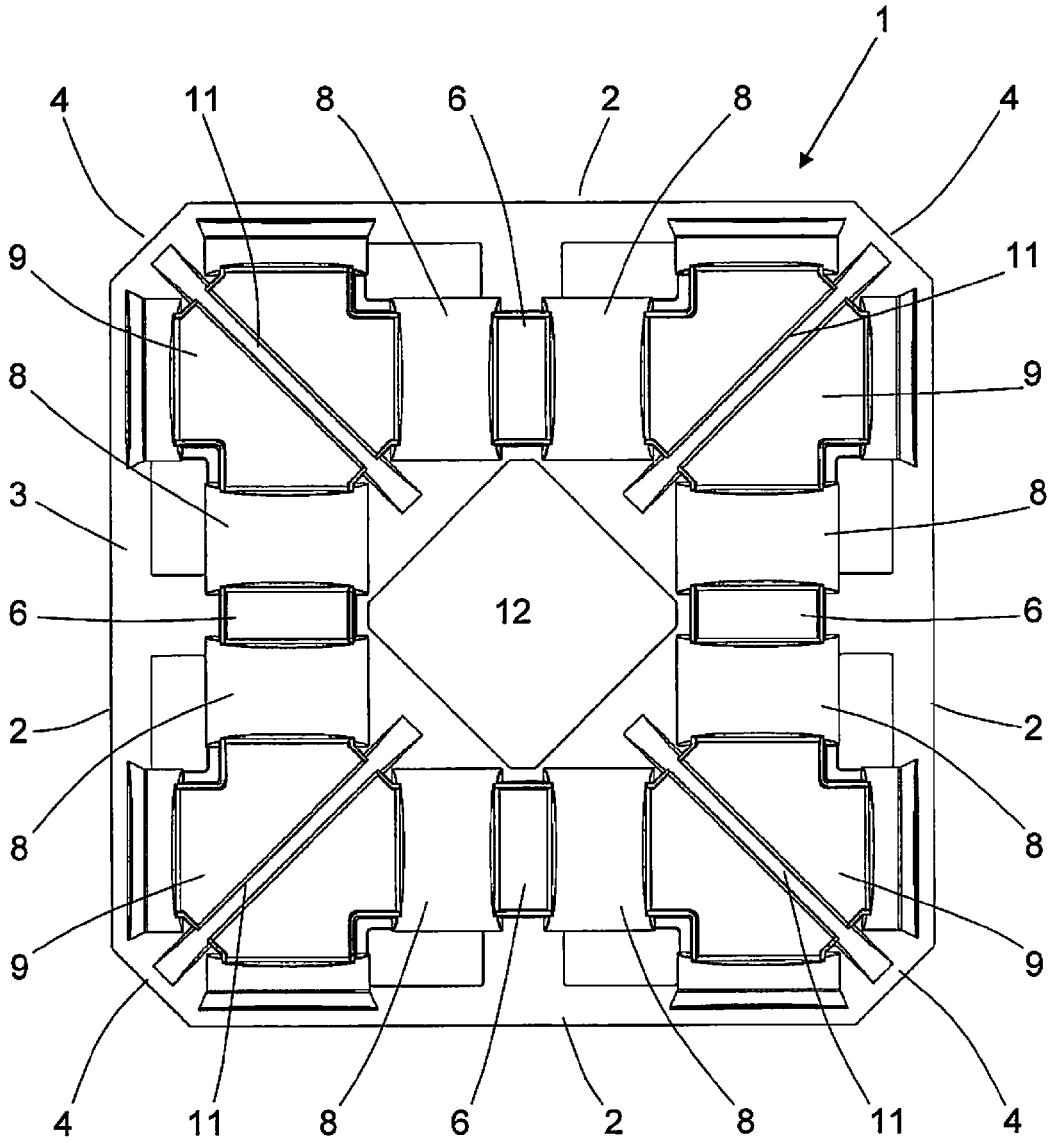
FIG. 1*a*, 1*b* are top views of a plastic pallet for flexible bulk containers.
Figure 1B:
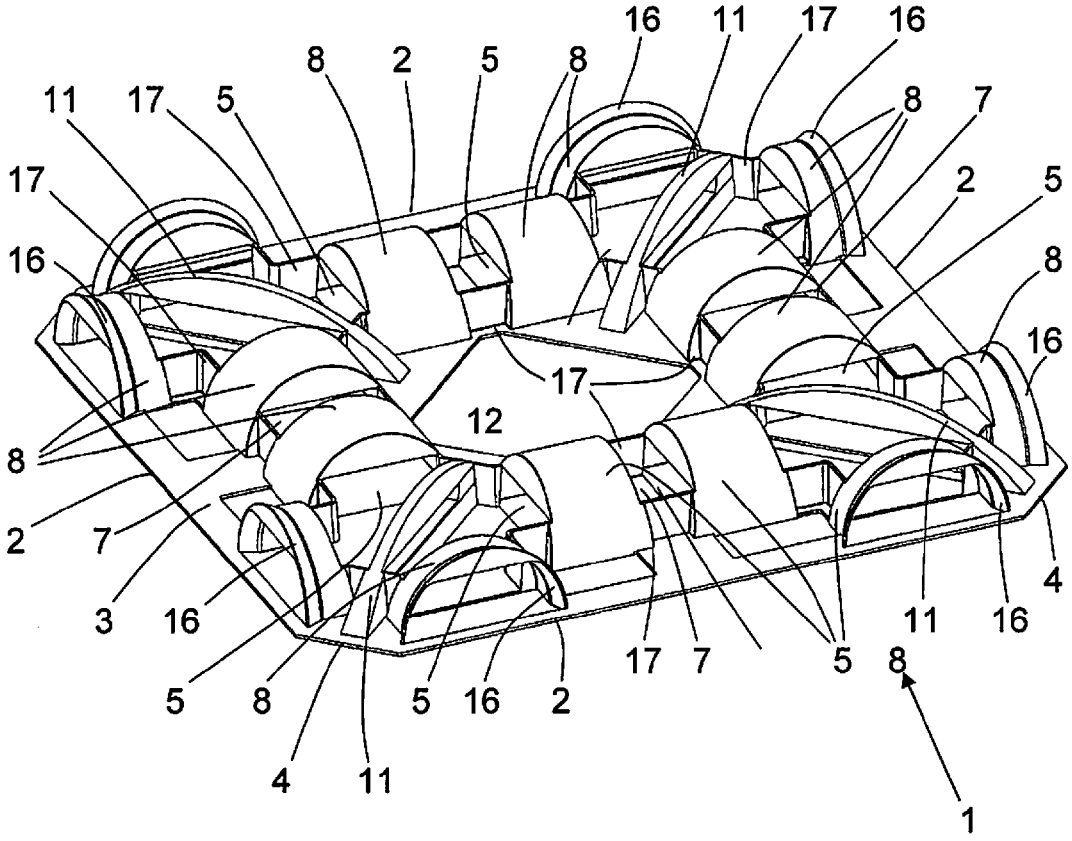

FIG. 1*a* is a top plan view of a plastic pallet 1 for taking up flexible bulk containers. FIG. 1*b* shows the same pallet in perspective as seen obliquely from above. The plastic pallet 1 comprises at least one pair of tunnel-shaped receptacles for the tines of a forklift, with the tunnel-shaped receptacles connecting two opposite sides 2 of the plastic pallet 1. In the example shown in FIGS. 1*a* and 1*b*, the plastic pallet 1 comprises four tunnel-shaped receptacles, which are arranged in pairs crossing each other. Thus, each of the four sides 2 is connected to its opposite by two tunnel-shaped receptacles, so that forklift tines can enter the tunnel-shaped receptacles from each of the sides 2. The tunnel-shaped receptacles are arranged on a base plate 3, which forms the bottom of the plastic pallet, is arranged horizontally as a rule, and generally has a square shape, corresponding, e.g., to the form of the bulk containers to be transported. In the present case, the corners formed by every two sides 2 of base plate 3 are beveled by means of chamfers 4. This is a precaution against damage caused to bulk containers by sharp corners when loaded pallets are stacked and/or transported.

Figure 2A:
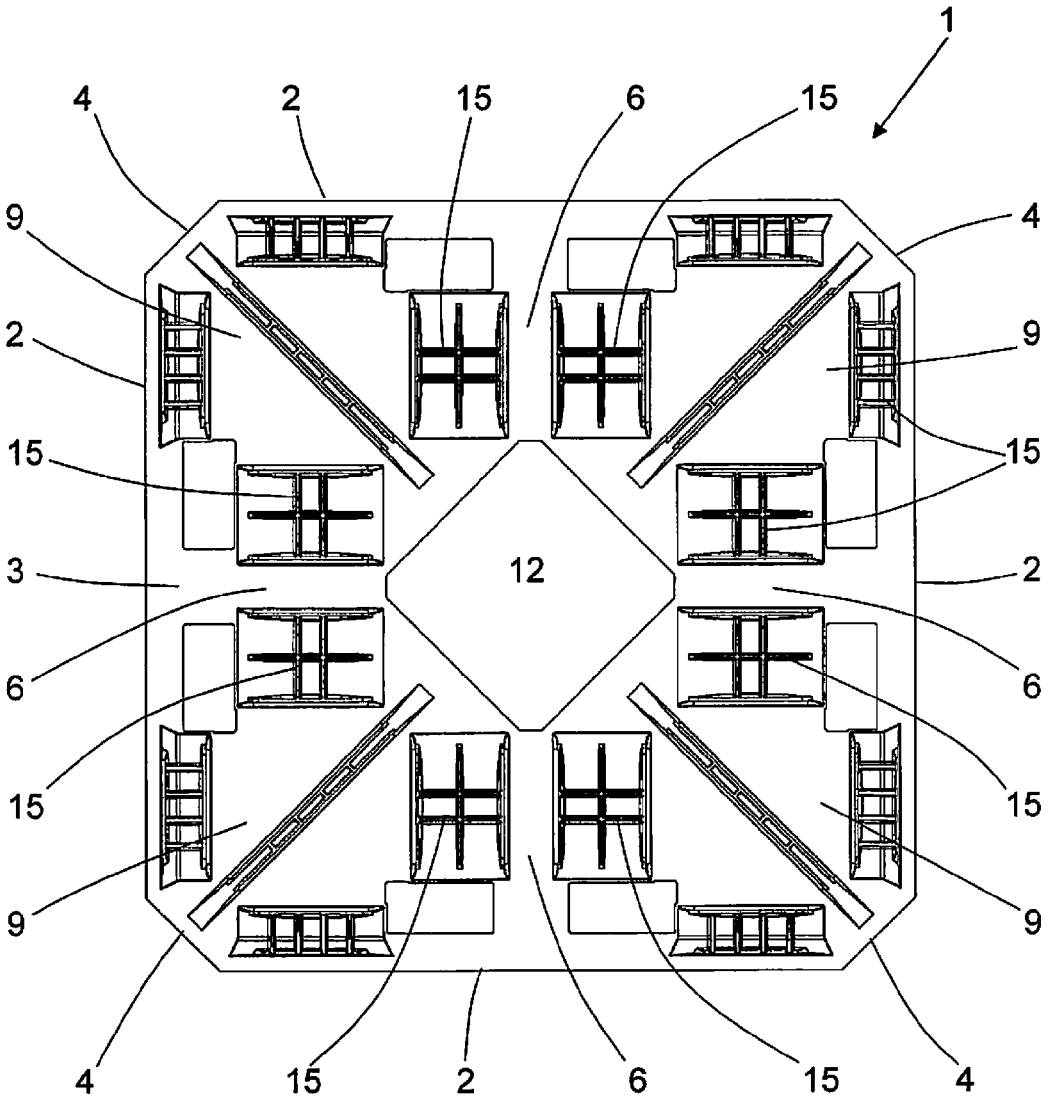
FIG. 2*a*, 2*b* are bottom views of the plastic pallet.
Figure 2B:
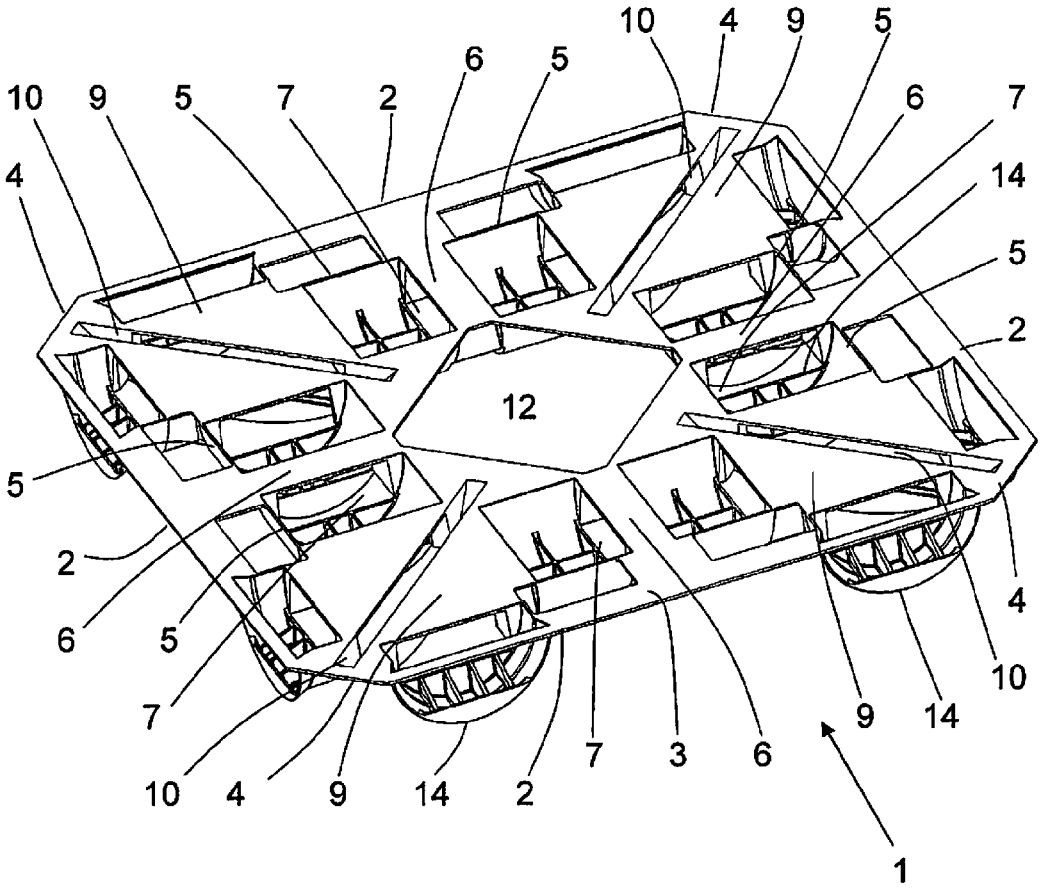

Each tunnel-shaped receptacle has a tunnel bottom formed by bottom ribs 6, which are spaced from each other by bottom air gaps 5. Because, in the present case, four tunnel-shaped receptacles are arranged in pairs crossing each other, and because the crossing areas, which will be dealt with below, occupy relatively much space compared with the dimensions of the plastic pallet 1, each tunnel-shaped receptacle has only one bottom rib 6 here. In case of plastic pallets 1 with greater side lengths, a pallet is provided with more than one bottom rib 6. This is regularly the case also with an embodiment having only two tunnel-shaped receptacles, and with an embodiment having narrower ribs. The bottom air gap 5 by which the bottom ribs 6 are spaced from each other and by which, in the present example, the bottom rib 6 is spaced from the crossing areas of the tunnel-shaped receptacles, can be seen in FIG. 2. Here, FIG. 2*a* is a plan view of the bottom side of the plastic pallet shown in FIG. 1, and FIG. 2*b* is a perspective view of the bottom side of the plastic pallet shown in FIG. 1.

Further, each of the tunnel-shaped receptacles has a vault formed by vault ribs 8, which are spaced from each other by vault air gaps 7. Here, the vault ribs 8 are of an arched shape. They may also be rectangular or polygonal in shape, but an arched design is advantageous because of the absence of edges that possibly could damage a flexible bulk container resting on the pallet or exert an excessive load on it. Rounded surfaces do not provide such points of attack.

It is a special characteristic of the plastic pallet 1 that, in each of the tunnel-shaped receptacles, bottom ribs 6 and vault ribs 8 are staggered and dimensioned in such a way that each rib 6 is arranged below a vault air gap 7, and each vault rib 8 is arranged above a bottom air gap 5. The ribs may each be slightly narrower than the air gaps above or below which they are arranged, this slight undersize permitting better stackability. In particular, the specific arrangement of the ribs and air gaps makes the plastic pallets 1 nestable, although the tunnel-shaped receptacles have a bottom structure that improves the stackability of loaded pallets.

There are several possibilities to configure a crossing area of two tunnel-shaped receptacles. In the embodiment shown here, the der crossing area comprises a bottom plate 9 covering it, in which at least one crossing air gap 10 is provided, with a crossing vault rib 11 being arranged above the at least one crossing air gap 10. Here again, the crossing air gap can be sized slightly greater than the width of the crossing vault rib 11, which facilitates stacking the pallets. Advantageously, the crossing air gap 10 and, thus, the crossing vault rib 11 enclose like angles with the two longitudinal axes of the tunnel vaults crossing each other there. As, in case of a pallet having a square floor plan, the tunnel vaults intersect at a right angle, the crossing air gap 10 forms an angle of 45° with the longitudinal axes.

Figure 3:
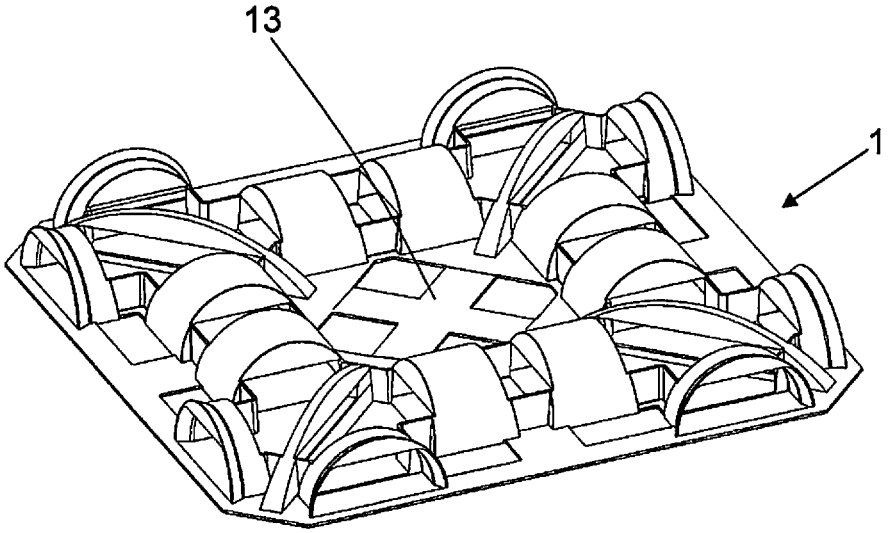
FIG. 3 is a top view of another embodiment of a plastic pallet.
Figure 4:
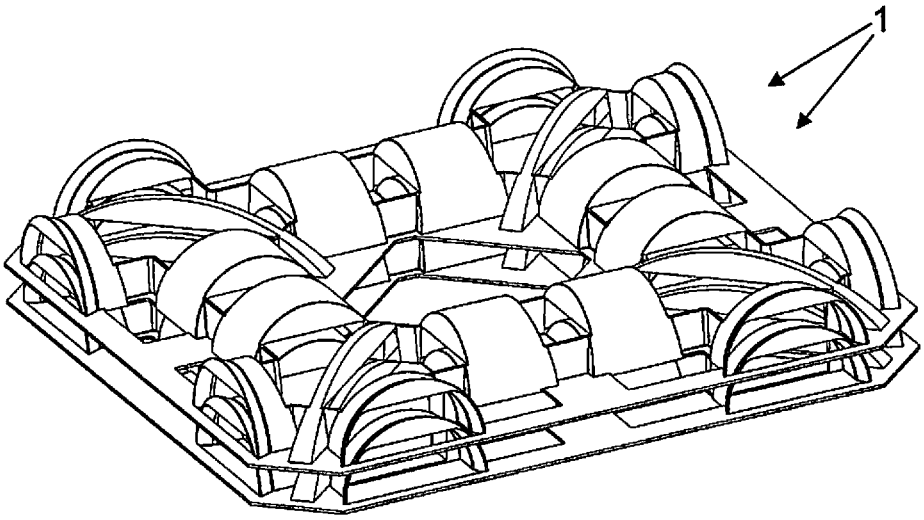
FIG. 4 shows a nested stack of two plastic pallets.

In the plastic pallet shown in FIG. 1*s*, 1*b*, 2*a*, 2*b*, a hole 12 for emptying a flexible bulk container is arranged between the at least two tunnel-shaped receptacles. In another embodiment, shown in FIG. 3, the hole is covered with a reversibly removable lid. This may be connected with the rest of the plastic pallet 1 via clip locks provided on several sides of the hole 12 or via a hinge; in the latter case, the lid need not be made completely removable, but can, e.g., be swung open. On the side opposite the hinge, a clip lock or a snap-fit hook may be provided.

Further, flat supports 14 for the tines of a forklift are provided in the vault ribs 8, the sad supports facing the inside of the tunnel, running horizontally and parallel to the base plate 3. This increases the stability during transporting the loaded pallet, because then the tines contact the vault ribs 8 not only at their edges but also over a larger and flat area, so that the forces are distributed more evenly and the load on the plastic pallet 1 is reduced. For example; as shown here, the vault ribs 8 may be configured as hollow ribs open towards the inside of the tunnel, with stiffening elements 15 being provided in the said hollow ribs, and with at least part of the stiffening elements having a flat, i.e. horizontal bottom side—here, e.g., the bottom edges of the stiffening elements—intended to rest on the tines of the forklift.

On the outer sides of such vault ribs 8 that form an entry opening of a tunnel-shaped receptacle, the plastic pallet 1 is finally provided with a flared rim 16 each, which serves as an entering aid for a forklift tine, i.e. the vault ribs 8 are adapted to taper from the outside, i.e. the tunnel portal, towards the inside.

Further, the bottom ribs 6 and the vault ribs 8 each have ends with which they are connected to the tunnel sidewalls 17. This increases the stability of the structure; also, the tunnel sidewalls 17 serve as a guideway for the forklift tines and, in addition, prevent the flexible bulk container from spreading, by way of adjusting movements of the bulk material in the container, into the tunnel-shaped receptacle where the container could be destroyed by the forklift tines.

Further, in the bottom region where the vault ribs 8 and the crossing vault ribs 11 connect to the base plate 3, the ribs are thickened, which further increases the stability of the structure.

A plastic pallet 1 of the kind described above is not only nestable but also it can be stacked with bulk containers carried by it; moreover, a bulk container in a stack, with a pallet placed on top of it, is efficiently protected against damage caused by the fork tines of a forklift apparatus.

We claim:

1. A plastic pallet for taking up flexible bulk containers, comprising a base plate defining a plurality of apertures, the plurality of apertures including a plurality of bottom air gaps;

a plurality of vault ribs, each vault rib comprising a first end fixed to the base plate, a second end fixed to the base plate, and an intermediate portion extending therebetween, wherein the intermediate portion of each vault rib extends across and above one of the bottom air gaps defined by the base plate;

the base plate including a plurality of bottom rib portions, each bottom rib portion extending between a first bottom air gap defined by the base plate and a second bottom air gap defined by the base plate, each bottom rib portion being disposed below a vault air gap, each vault air gap being defined between a first vault rib extending above the first bottom air gap and a second vault rib extending above the second bottom air gap;

the vault ribs and the base plate defining four tunnel-shaped receptacles for receiving tines of a fork of a forklift apparatus, with the tunnel-shaped receptacles being arranged in pairs crossing each other and connecting two mutually opposite sides of the plastic pallet, in which a tunnel bottom of each tunnel-shaped receptacle is defined by the base plate, and a tunnel vault of each tunnel shaped receptacle is defined by vault ribs spaced from each other by vault air gaps;

the base plate defining a first crossing air gap that extends under a first tunnel-shaped receptacle and a second tunnel-shaped receptacle at a location where the first tunnel-shaped receptacle and the second tunnel-shaped receptacle intersect each other; and the plastic pallet including a first crossing rib, the first crossing rib having a first end fixed to the base plate, a second end fixed to the base plate, and an intermediate portion extending above the first crossing air gap.

2. A plastic pallet as claimed in claim 1, wherein the vault ribs are configured in an arched shape.

3. A plastic pallet as claimed in claim 1, further comprising a plurality of tunnel side walls, each tunnel sidewall comprising a first end fixed to one vault rib, a second end fixed to another vault rib, and an intermediate portion fixed to the base plate.

4. A plastic pallet as claimed in claim 3, wherein a hole for emptying the flexible bulk container is arranged between the at least two tunnel-shaped receptacles.

5. A plastic pallet as claimed in claim 4, wherein the hole is covered with a lid that is reversibly removable or hinged.

6. A plastic pallet as claimed in claim 1, wherein: a first angle is defined between the first tunnel-shaped receptacle and the first crossing air gap;

a second angle is defined between the second tunnel-shaped receptacle and the first crossing air gap; and the first angle is equal to the second angle.

7. A plastic pallet as claimed in claim 6, wherein a hole for emptying the flexible bulk container is arranged between the at least two tunnel-shaped receptacles.

8. A plastic pallet as claimed in claim 6, further comprising a plurality of flat supports fixed to each vault rib for contacting the tines of the fork of the forklift apparatus.

9. A plastic pallet as claimed in claim 1, further comprising a plurality of flat supports fixed to each vault rib for contacting the tines of the fork of the forklift apparatus.

10. A plastic pallet as claimed in of claim 9, wherein each vault rib is arch shaped and a stiffening element is fixed to each vault rib, each stiffening element including a flat bottom side for resting on the tines of the fork of the forklift apparatus.

11. A plastic pallet as claimed in claim 9, wherein a flared rim serving as an entering aid for a forklift apparatus is configured on the outer sides of those vault ribs that form an end opening of a tunnel-shaped receptacle.

12. A plastic pallet as claimed in claim 1, wherein each vault rib is arch shaped and a stiffening element is fixed to each vault rib, each stiffening element including a flat bottom side for resting on the tines of the fork of the forklift apparatus.

13. A plastic pallet as claimed in claim 12, wherein a flared rim serving as an entering aid for a forklift apparatus is configured on the outer sides of those vault ribs that form an end opening of a tunnel-shaped receptacle.

14. A plastic pallet as claimed in claim 1, wherein a flared rim serving as an entering aid for a forklift apparatus is configured on the outer sides of those vault ribs that form an end opening of a tunnel-shaped receptacle.

15. A plastic pallet for taking up flexible bulk containers, comprising:

a base plate including a plurality of bottom ribs; and a plurality of arch shaped vault ribs connecting to the base plate;

wherein, the plurality of arch shaped vault ribs and the plurality of bottom ribs define first and second pairs of tunnel-shaped receptacles for receiving tines of a fork of a forklift apparatus;

wherein, the base plate has a void corresponding to each arch shaped vault rib facilitating stacking of a plurality of the pallets;

the base plate defining a first crossing air gap that extends under a first tunnel-shaped receptacle of the first pair of tunnel-shaped receptacles and a second tunnel-shaped receptacle of the second pair of tunnel-shaped receptacles at a location where the first tunnel-shaped receptacle and the second tunnel-shaped receptacle intersect each other; and the plastic pallet including a first crossing rib, the first crossing rib having a first end fixed to the base plate, a second end fixed to the base plate, and an intermediate portion extending above the first crossing air gap.

16. A plastic pallet as claimed in claim 15, wherein a hole for emptying the flexible bulk container is arranged between the at least two tunnel-shaped receptacles.

17. The plastic pallet of claim 15 wherein the base plate and vault ribs are unitary with one another.

18. A plastic pallet as claimed in claim 15, wherein the plurality of vault ribs each comprise stiffening ribs facing the inside of the tunnel for the tines of the fork of a forklift apparatus.

19. A plastic pallet as claimed in claim 15, wherein each vault rib is arch shaped and a stiffening element is fixed to each vault rib, each stiffening element including a flat bottom side for resting on the tines of the fork of the forklift apparatus.

20. A plastic pallet for taking up flexible bulk containers, comprising:

a base plate defining a plurality of apertures, the plurality of apertures including a plurality of bottom air gaps;

a plurality of vault ribs, each vault rib comprising a first end fixed to the base plate, a second end fixed to the base plate, and an intermediate portion extending therebetween, wherein the intermediate portion of each vault rib extends across one of the bottom air gaps defined by the base plate;

the vault ribs and the base plate defining first and second pairs of tunnel-shaped receptacles for receiving tines of a fork of a forklift apparatus, a bottom of each tunnel-shaped receptacle being defined by the base plate and a vault of each tunnel-shaped receptacle being defined by a plurality of the vault ribs; and the base plate defining a first crossing air gap that extends under a first tunnel-shaped receptacle and a second tunnel-shaped receptacle at a location where the first tunnel-shaped receptacle and the second tunnel-shaped receptacle intersect each other; and the plastic pallet including a first crossing rib, the first crossing rib having a first end fixed to the base plate, a second end fixed to the base plate, and an intermediate portion that extends above the first tunnel-shaped receptacle and the second tunnel-shaped receptacle at the location where the first tunnel-shaped receptacle and the second tunnel-shaped receptacle intersect each other.

* * * * *